73-152 SR
12/27/77 OR 4,064,749

United States Patent [19]
Pittman et al.
[11] 4,064,749
[45] Dec. 27, 1977

[54] METHOD AND SYSTEM FOR DETERMINING FORMATION POROSITY

[75] Inventors: Robert W. Pittman, Sugarland; Chester E. Hermes, Houston, both of Tex.

[73] Assignee: Texaco Inc., New York, N.Y.

[21] Appl. No.: 740,998

[22] Filed: Nov. 11, 1976

[51] Int. Cl.[2] ..... E21B 49/00
[52] U.S. Cl. ..... 73/152
[58] Field of Search ..... 73/151, 151.5, 152

[56] References Cited

U.S. PATENT DOCUMENTS

| | | | |
|---|---|---|---|
| 3,898,880 | 8/1975 | Kelseaux et al. | 73/151.5 |
| 3,916,684 | 11/1975 | Rundell | 73/151.5 |

*Primary Examiner*—Jerry W. Myracle
*Attorney, Agent, or Firm*—Thomas H. Whaley; Carl G. Ries; Henry C. Dearborn

[57] ABSTRACT

A method and/or system for measuring formation porosity from drilling response. It involves measuring a number of drilling parameters and includes determination of tooth dullness as well as determining a reference torque empirically. One of the drilling parameters is the torque applied to the drill string.

8 Claims, 5 Drawing Figures

METHOD AND SYSTEM FOR DETERMINING FORMATION POROSITY

BACKGROUND OF THE INVENTION

1. Field of the Invention

This invention concerns generally a method and/or system for use in rotary-type well-drilling operations. More specifically, it concerns a method for determining porosity of a formation from drilling response.

2. Description of the Prior Art

In the past, there have been some suggestions for obtaining data as a well is drilled and making a record thereof. Such suggestions purport to obtain such data in various ways. For example, there is an article titled "The Drilling Porosity Log (DPL)" by William A. Zoeller, which was the subject of a Society of Petroleum Engineers of AIME paper number SPE-3066. However, such past efforts have not proved practical in producing useful results.

On the other hand, a U.S. Pat. No. 3,916,684 issued Nov. 4, 1975 has disclosed a practical invention for developing a surface drilling log which indicates a formation parameter as described therein. By adding to that invention a torque measurement and by applying the concepts of this invention, a porosity logging method according to this invention may be defined.

SUMMARY OF THE INVENTION

Briefly, the invention concerns a method for determining porosity of a formation from drilling response, wherein a bit is attached to the lower end of a drill string that is rotated while the downward force on said bit is controlled. It comprises the steps of measuring the revolutions of said bit, and measuring the depth of said bit in the borehole. It also comprises measuring the weight on said bit, and determining the tooth dullness of said bit. In addition, it comprises measuring the torque applied to said drill string, and determining a reference torque empirically as well as determining said porosity by combining said measurements and determinations.

Again briefly, the invention concerns a system for determining porosity of a formation from drilling response. In the system, a bit is attached to the lower end of a drill string that is rotated while the downward force on said bit is controlled, and the torque applied to rotate said drill string is measured. The system comprises in combination means for measuring the revolutions of said bit including a tachometer, and means for measuring the depth of said bit in the borehole. The system also comprises means for determining the tooth dullness of said bit, and means for correlating said measurements and determination in accordance with the equation:

$$\phi = \frac{1}{\mu} \ln \left\{ \frac{\sigma \text{ ca max}}{\frac{480\,NT}{D^2R} - P_e \left( \frac{1 + \cos\left[2 \operatorname{arc\,cot}\left(\frac{4T}{WD}\right)\right]}{1 - \cos\left[2 \operatorname{arc\,cot}\left(\frac{4T}{WD}\right)\right]} \right)} \right\}$$

wherein:

$\mu$ = ratio of total porosity to the porosity effecting the atmospheric compressive strength $ln$ = natural logarithm of $N$ = rotational speed of bit $T$ = torque $P_e$ = effective confining pressure $D$ = bit diameter $R$ = penetration rate $W$ = weight on bit $\sigma$ca max = atmospheric compressive strength extrapolated back to zero porosity, in order to represent a porosity parameter of the formation. The system also comprises means for recording said porosity parameter on a record medium as it is advanced, and means for advancing said record medium in accordance with the depth of said bit.

BRIEF DESCRIPTION OF THE DRAWINGS

The foregoing and other objects and benefits of the invention will be more fully set forth below in connection with the best mode contemplated by the inventors of carrying out the invention, and in connection with which there are illustrations provided in the drawings, wherein.

DETAILED DESCRIPTION

It has been discovered that by making use of the signals developed from determining the dimensionless ratio T/WD which was described in a U.S. Pat. No. 3,782,190, along with a drilling parameter according to the above mentioned U.S. Pat. No. 3,916,684, an output that is in accordance with the porosity of the formation being drilled may be developed.

An analytical relationship between rock porosity and compressive strength has been determined by laboratory drilling work with roller cone rock bits, to be in accordance with the following relationship:

$$\phi = \frac{1}{\mu} \ln \left( \frac{\sigma \text{ ca max}}{\sigma \text{ ca}} \right) \tag{1}$$

where "$\phi$" stands for porosity; "$\mu$" stands for the ratio of total porosity to the porosity effecting the atmospheric compressive strength; "$ln$" stands for "natural logarithm of"; and "$\sigma ca$" stands for atmospheric compressive strength.

This mechanical porosity can be written as:

$$\phi = \tag{2}$$

-continued $$\frac{1}{\mu}\ln\left\{\frac{\sigma\ ca\ max}{\frac{480\,KNW^{\alpha}}{D^2R} - P_e\left(\frac{1+\cos\left[2\ \mathrm{arc\ cot}\left(\frac{4T}{WD}\right)\right]}{1-\cos\left[2\ \mathrm{arc\ cot}\left(\frac{4T}{WD}\right)\right]}\right)}\right\}$$

which brings in the effect of the rock failure mode as described by the dimensionless ratio (4T/WD) as mentioned above, and the effective confining pressure $P_e$. The other terms of the equation (2) stand for the following:

$K$ = The intercept of torque vs. weight on bit
$N$ = rotational speed of bit
$W$ = weight on bit
$\alpha$ = slope of torque vs. weight on bit
$D$ = bit diameter
$R$ = penetration rate
$T$ = torque
$\sigma ca$ max = atmospheric compressive strength extrapolated back to zero porosity.

But, since "bit to surface" signals are not available as a practical matter, the surface measurement of torque and weight at prescribed conditions must be made on a footage interval basis. This would consist of first "weighing" the drill string and rotating, to determine viscous drill string torque, and second of making a series of short duration weight vs. torque checks at a fixed (low) rotary speed to determine K and $\alpha$ in equation (2). Under such procedure, the equation (2) can be rewritten as follows:

$$\phi = \frac{1}{\mu}\ln\left\{\frac{\sigma\ ca\ max}{\frac{480\,NT}{D^2R} - P_e\left(\frac{1+\cos\left[2\ \mathrm{arc\ cot}\left(\frac{4T}{WD}\right)\right]}{1-\cos\left[2\ \mathrm{arc\ cot}\left(\frac{4T}{WD}\right)\right]}\right)}\right\} \quad (3)$$

This equation can be evaluated by two measurements of torque, one at zero weight and one at a reasonable drilling weight, with both measurements made at a fixed, low rotary speed. The porosity indication so obtained is an incremental measurement. Two terms the equation will require estimation, and these are the "$\sigma ca$ max" and the "$P_e$". However, they may be determined on the basis of offset well data and experience.

Figure 1:
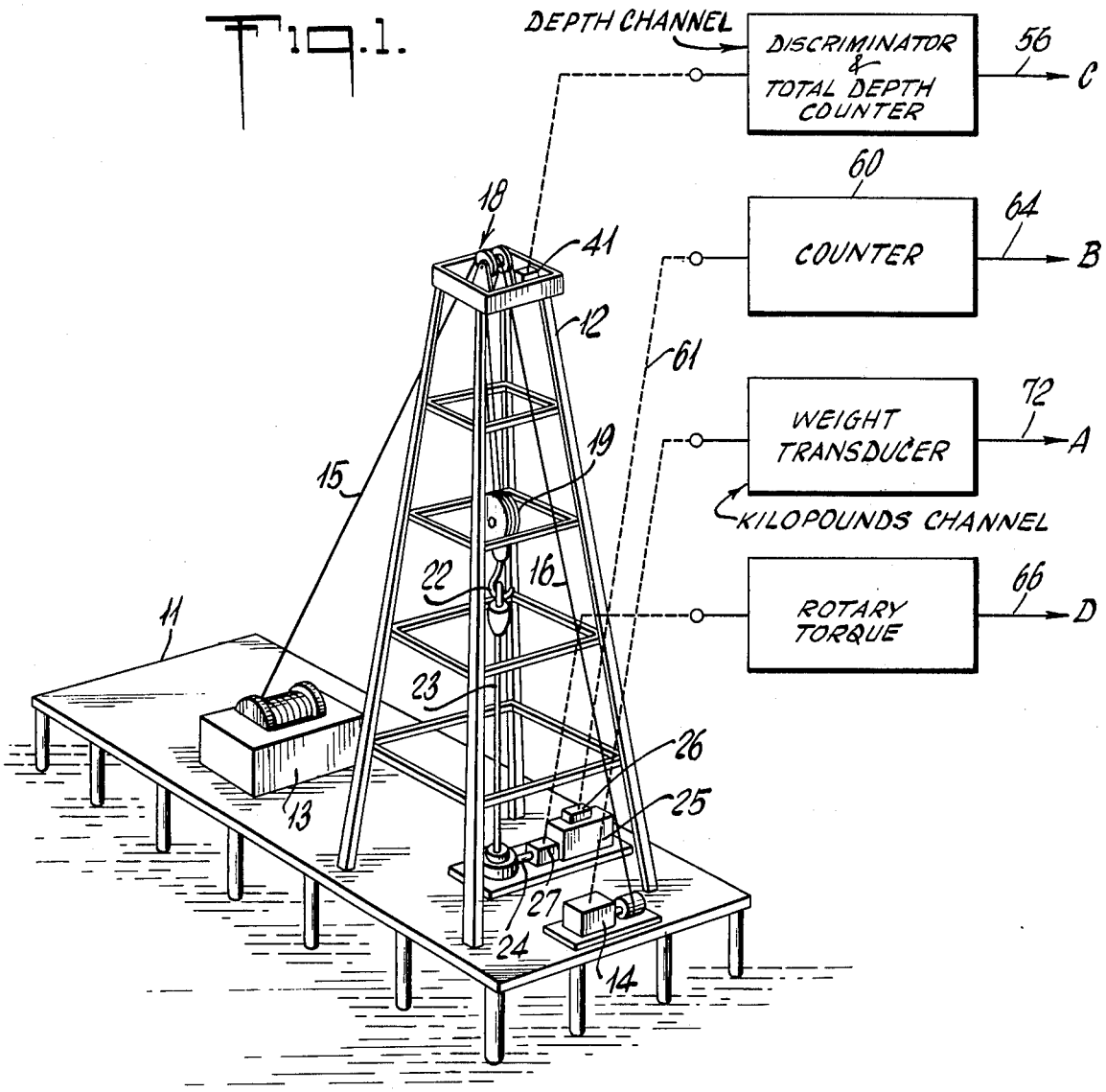
FIG. 1 is a schematic perspective with blockdiagram showings, which illustrates a rotary-type drilling rig with elements for carrying out the invention.

Referring now to FIG. 1, there is shown a drilling rig which includes a platform 11 upon which stands a derrick 12 and a draw works 13, as well as an anchor 14 for the free end or deadline of a cable or drilling line 15 that is threaded over the sheaves of a crown block 18 and a travelling block 19. The travelling block, of course has attached thereto the usual hook 22 for supporting the drill string (not shown) that is attached beneath a kelly 23. The drill string is rotated in a standard manner by a rotary drive employing an input shaft 24 that is being driven by an engine 25. There is also a tachometer 26 that provides an AC signal having a substantial number of cycles per revolution of the rotary drive shaft 24. While such tachometer signal may be developed in various ways, it may be developed by part of the apparatus which takes the form shown and described in a U.S. Pat. No. 3,295,367. Thus, it is an AC signal generator that develops thirty electrical cycles per revolution of the rotary drive shaft 24, and in a typical case, there would be a gear ratio such that there are five revolutions of the drive shaft for each revolution of the rotary table. Consequently, there is an AC signal generated which has one hundred and fifty electrical cycles per revolution of the rotary table. Of course, these numbers would vary somewhat depending upon the dimensions of the elements involved.

In addition, there is a torque meter 27 which might take various forms but is preferably like one shown and described in the above noted U.S. Pat. No. 3,295,367 issued Jan. 3, 1967. This basically develops a pair of AC signals which have a relative phase angle that is proportional to the torque being measured. Such phase angle is measured in terms of a D.C. analog signal which will be developed at a circuit connection 66, and is identified as the signal D.

In the foregoing manner, the rotation of the drill string and the bit attached to the lower end thereof may be measured by increments of the revolutions. This is so since the signal developed by the tachometer 26 provides an AC signal having a predetermined number of cycles for each revolution. This aspect is described in more detail in U.S. Pat. No. 3,774,445 issued Nov. 27, 1973. However, since use in made of the number of turns, there is a single pulse per revolution also developed.

Figure 2:
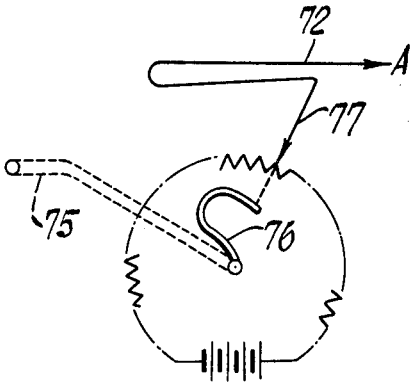
FIG. 2 is a schematic indication of a weight sensor which measures hook load.

In order to measure the weight being applied to the bit, the anchor 14 has a hook-load weight indicator which acts in the manner described in the aforementioned U.S. Pat. No. 3,774,445. Thus, as indicated in FIG. 2, there is a hydraulic tubing 75 that is indicated in dashed lines in FIG. 2. Hydraulic fluid in the tubing 75 applies fluid pressure to a Bourdon tube 76 that actuates a potentiometer sliding contactor 77 to produce a variable DC output. Thus, the hook-load weight measurement determines the amount of hydraulic pressure in the tubing 75 and sets the slider 77 of the potentiometer. This produces the indicated DC signal on a circuit line 72, which is indicated in the drawings by a capital letter A.

Figure 3:
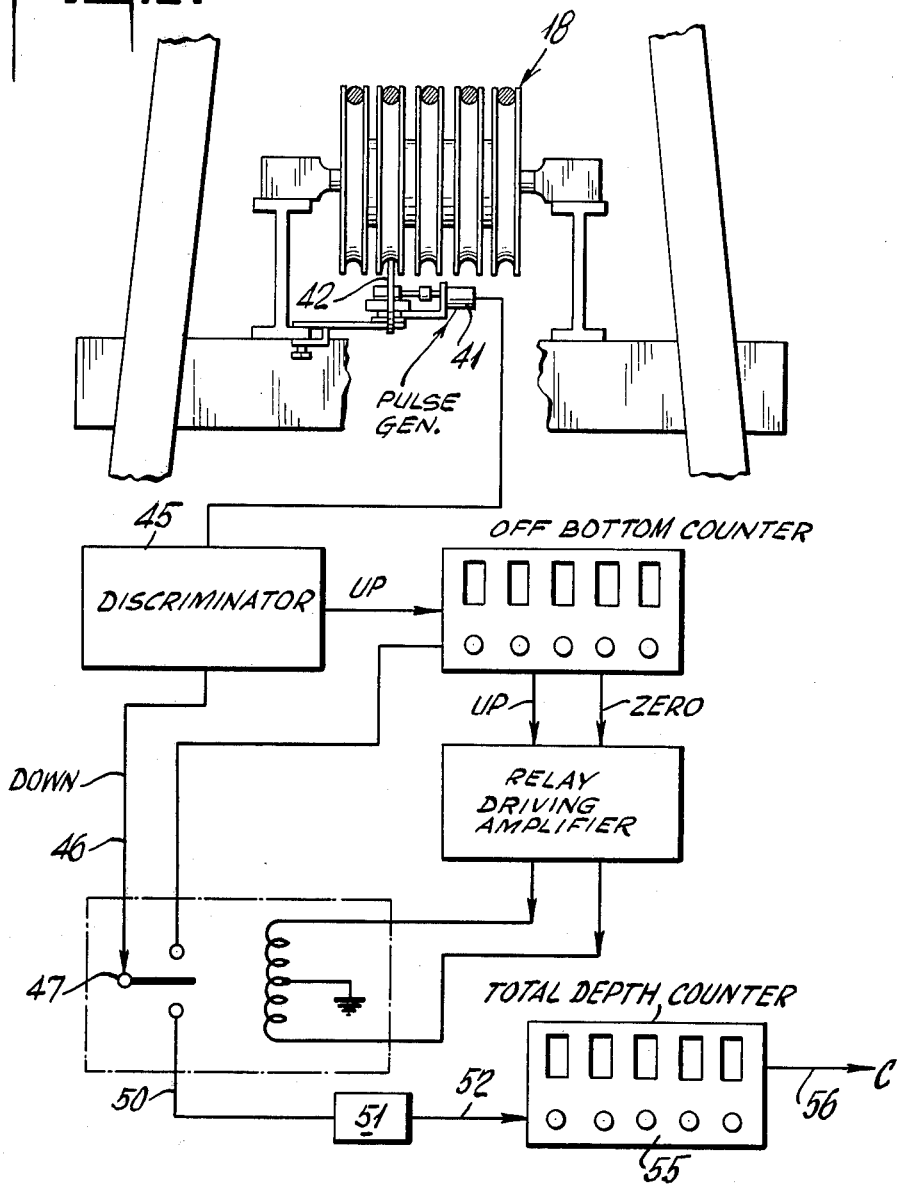
FIG. 3 is a schematic diagram including a blockdiagram circuit showing, that illustrates in greater detail the element in FIG. 1 which develops signal C thereof.

In order to measure the depth of the bit in the hole, there is a pulse generator 41, shown in more detail in FIG. 3. It is driven from a resilient rimmed wheel 42 which is in friction contact with the underside of one of the sheaves of the crown block 18. In order to take account of only the downward movement of the bit, the signals from the pulse generator 41 are directed to a discriminator 45 that provides output signals over a circuit 46 which leads to a single-pole double-throw switch 47. When the pulses that represent the downward direction are being developed, they will be connected to a circuit 50 that leads to one side of a calibrator element 51 from which the circuit continues via a line 52 to a total-depth counter 55. The output of this counter is a depth signal that is carried over a circuit connection 56 which is identified as the signal C. The details of this depth-measuring pulsecounter system, with the exception of the calibrator element 51, are like the system disclosed in a U.S. Pat. No. 3,643,504.

The calibrator element 51 might take various forms, and it acts periodically to add or subtract a pulse so as to correct for slight size errors in the wheel 42. It is preferably a presettable counter that, when filled, will either add a count, i.e., pulse, to the pulses on line 50, or block the next count, i.e., pulse, from passing. The principles are shown and explained in a U.S. Pat. No. 3,947,664.

It will be understood that the depth measurement may be made down on the rig floor without changing the principles involved. This could be done using conventional instrumentalities.

In order to make a measurement of the revolutions of the drill string, there is a counter 60 (see FIG. 1) that has its input connected to the tachometer 26, as is indicated by a dashed line 61. The revolution counter 60 provides an output signal on circuit 64 which is identified as signal B. This is an AC signal having the frequency described above such that there are approximately one hundred and fifty electrical cycles for each revolution of the drill string. It is reduced to one pulse per revolution to be used in correlating the four signals A, B, C and D.

In order to measure the torque that is being applied to the rotary drive shaft 24 and consequently to the drill string at the surface, there is the above noted torque meter 27 which develops a torque signal that is supplied over the circuit connection 66. This is identified as the signal D. It is multiplexed with the signal A for the purposes of the correlation of the four signals, which was indicated above.

Figure 4:
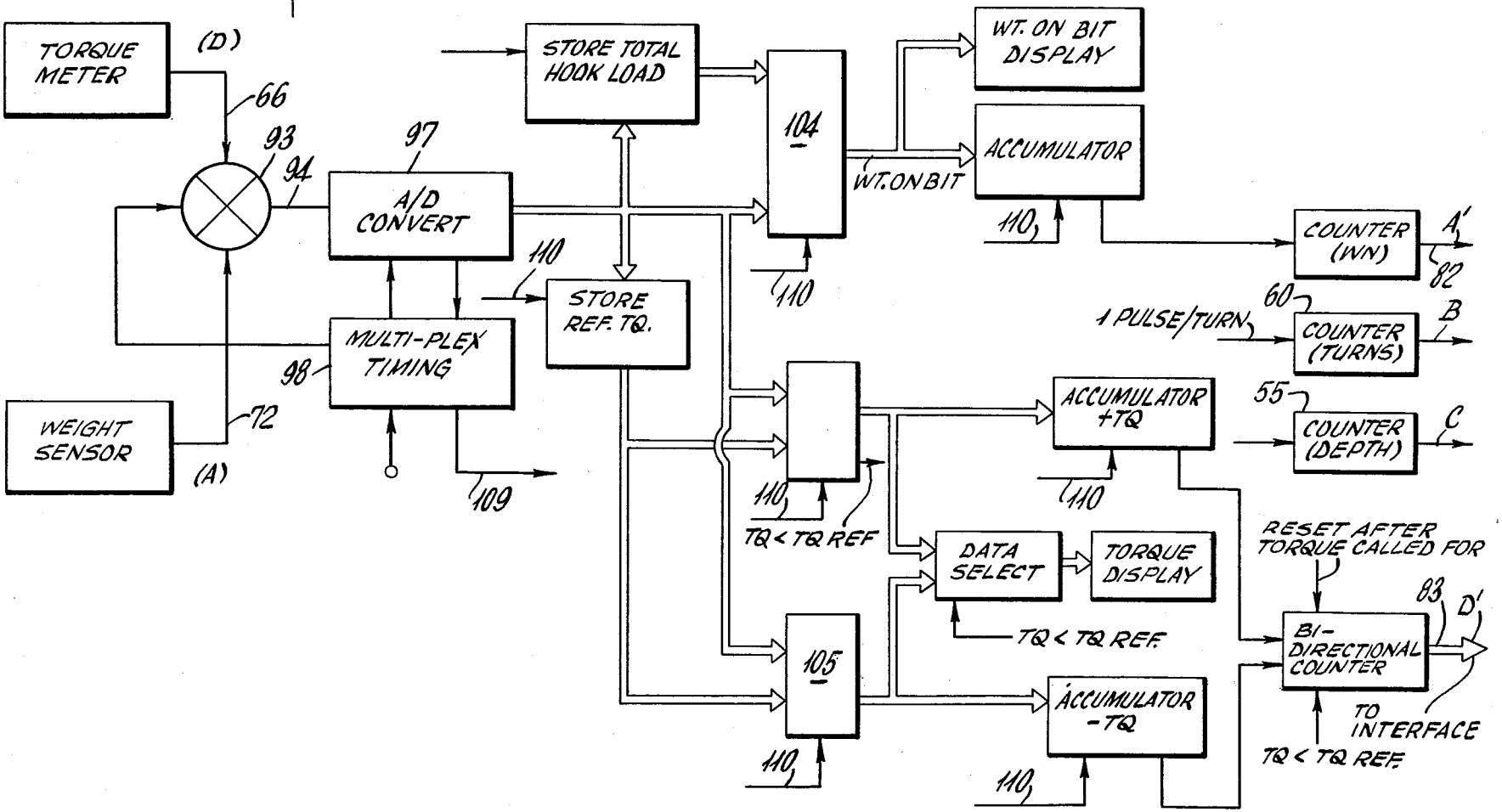
FIG. 4 is a block diagram indicating the flow of data involved in the multiplexing of the weight and torque signals, and indicating the parallel computer inputs for revolutions and depth signals B and C to the system indicated by FIG. 5.

FIG. 4 illustrates in block diagram form the electronic circuits involved in handling the torque and weight signals in accordance with the above described equations. It will be understood that a symbol which is designated by reference number 93 is employed to indicate the fact that multiplexing input is used as between the weight signals (on circuit connection 72) and the torque signals (on circuit connection 66). The multiplex timing which is indicated by a block numbered 98 causes switching so as to connect these alternate inputs over a circuit connection 94 to a single analog-to-digital converter 97. The output 94 of this A/D converter 97 goes to both of the circuit elements 104 and 105, shown in the block diagram. These are for handling, respectively, the weight (signal A) and the torque (signal D) that go to the input of the converter 97. It may be noted that the outputs of A/D converter 97 are continuously connected to the various outputs indicated, but that only the appropriate circuits are activated during each portion of a complete cycle. Consequently, the multiplexed weight signals (A') and torque signals (D') will appear alternately on the output circuits 82 and 83 to become inputs to the calculator 91 (FIG. 5) as will be described below. The multiplex timing to accomplish such alternative activation is controlled by multiplex timing circuits which are indicated by an arrow 109 out from the block 98 and the various arrows 110 into the elements connected to the outputs of the A/D converter 97.

Figure 5:
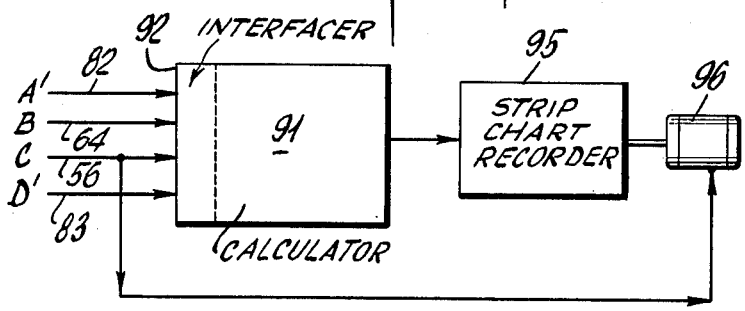
FIG. 5 is a schematic block diagram indicating the elements involved in correlating the four input signals developed by the system according to FIG. 1, so as to produce a record of the porosity.

FIG. 5 illustrates, in block-diagram form, the way in which the measured quantities are correlated so as to develop a porosity log at the surface, as the well is drilled. The arrangement includes a calculator 91 that may be any of various electronic calculators, e.g., one manufactured by Wang Laboratories, Inc., Tewksbury, Mass., designated Model 700A or 700B. However, in such case there is required an interfacer 92 in order to transform the signals as they are developed in the system and supplied over connections 82, 64, 56 and 83 which are described as signals A', B, C and D', respectively. These signals are transformed from binary coded digital signals to binary sixteen for input to the calculator. Such interfacer 92 may be one (with modifications) like that manufactured by Adams-Smith, Inc., Needham Heights, Mass., designated Model 100 Instrument Interface for feeding electrical measurements to the WANG 700 Series Calculators.

The measured data as represented by signals A', B, C and D' is correlated in accordance with the above noted expression (3) so as to provide an output that may be applied to a strip chart recorder 95 which is advanced by a stepping motor 96. In this manner, the record shows the recorded porosity in accordance with the depth of the bit and irrespective of the time element.

A specific example of a program of providing a porosity drilling log in accordance with the invention is set forth below.

This program is applicable to a Wange electronic calculator Model 700 such as indicated above. It should be noted that the carrying out of trigonometric calculations is processed within steps 0007 through 0168. Also, input data is processed for use in the equation in accordance with the comments shown.

The program codes for a 700 series Wang calculator are as follows:

700 SERIES PROGRAM CODES

| Code | Key | Code | Key |
|---|---|---|---|
| 0400 | + DIRECT | 0601 | − |
| 0401 | − DIRECT | 0602 | × |
| 0402 | × DIRECT | 0603 | ÷ |
| 0403 | ÷ DIRECT | 0604 | ↑ |
| 0404 | STORE DIRECT | 0605 | ↓ |
| 0405 | RECALL DIRECT | 0606 | ↓↑ |
| 0406 | ⇄ DIRECT | 0607 | \| X \| |
| 0407 | SEARCH | 0608 | INTEGER X |
| 0408 | MARK | 0609 | $\pi$ |
| 0409 | GROUP 1 | 0610 | $Log_{10}X$ |
| 0410 | GROUP 2 | 0611 | $Log_eX$ |
| 0411 | WRITE | 0612 | $\sqrt{X}$ |
| 0412 | WRITE ALPHA | 0613 | $10^x$ |
| 0413 | END ALPHA | 0614 | $e^x$ |
| 0414 | STORE Y* | 0615 | 1/x |
| 0415 | RECALL Y* | | |
| | | 0700 | 0 |
| 0500 | + INDIR | 0701 | 1 |
| 0501 | − INDIR | 0702 | 2 |
| 0502 | × INDIR | 0703 | 3 |
| 0503 | ÷ INDIR | 0704 | 4 |
| 0504 | STORE INDIR | 0705 | 5 |
| 0505 | RECALL INDIR | 0706 | 6 |
| 0506 | ⇄ INDIR | 0707 | 7 |
| 0507 | SKIP if Y≧X | 0708 | 8 |
| 0508 | SKIP if Y<X | 0709 | 9 |
| 0509 | SKIP if Y=X | 0710 | SET EXP |

-continued

| | | | |
|---|---|---|---|
| 0510 | SKIP if ERROR | 0711 | CHANGE SIGN |
| 0511 | RETURN | 0712 | DECIMAL POINT |
| 0512 | END PROG | 0713 | $X^2$ |
| 0513 | LOAD PROG | 0174 | RECALL RESIDUE |
| 0514 | GO | 0715 | CLEAR X |
| 0515 | STOP | | |
| 0600 | + | | *ENTERED BY TOGGLE SWITCH SETTING |

FOR MODEL 720 ONLY

| *Code | Operation | *Code | Operation |
|---|---|---|---|
| 1200 | + DIRECT (+100) | 1205 | RECALL DIRECT(+100) |
| 1201 | − DIRECT (+100) | 1206 | ⇄ DIRECT(+100) |
| 1202 | × DIRECT (+100) | 1214 | STORE Y (+100) |
| 1203 | ÷ DIRECT (+100) | 1215 | RECALL Y (+100) |
| 1204 | STORE DIRECT (+100) | | |

Any of these codes automatically adds 100 to the Storage Register number.
*These codes are generated by toggle switches and special operation keys.

SPECIAL COMMANDS WHICH MUST BE PRECEDED BY WRITE ALPHA (Decimal Point Shifting)

| Code | Key | Operation |
|---|---|---|
| 0401 | − DIRECT | Divide X by $10^1$ |
| 0402 | × DIRECT | Divide X by $10^2$ |
| 0403 | ÷ DIRECT | Divide X by $10^3$ |
| 0404 | STORE DIRECT | Divide X by $10^4$ |
| 0405 | RECALL DIRECT | Divide X by $10^5$ |
| 0406 | ⇄ DIRECT | Divide X by $10^6$ |
| 0407 | SEARCH | Divide X by $10^7$ |
| 0408 | MARK | Divide X by $10^8$ |
| 0409 | GROUP 1 | Divide X by $10^9$ |
| 0400 | + DIRECT | Divide X by $10^{10}$ |
| 0701 | 1 | Multiply X by $10^1$ |
| 0702 | 2 | Multiply X by $10^2$ |
| 0703 | 3 | Multiply X by $10^3$ |
| 0704 | 4 | Multiply X by $10^4$ |
| 0705 | 5 | Multiply X by $10^5$ |
| 0706 | 6 | Multiply X by $10^6$ |
| 0707 | 7 | Multiply X by $10^7$ |

-continued

| | | |
|---|---|---|
| 0708 | 8 | Multiply X by $10^8$ |
| 0709 | 9 | Multiply X by $10^9$ |
| 0700 | 0 | Multiply X by $10^{10}$ |

DECISIONS

| Code | Key | Operation |
|---|---|---|
| 0410 | GROUP 2 | Skip if Y positive |
| 0411 | WRITE | Skip if Y = 0 |
| 0510 | SKIP if ERROR | Skip if Y negative |
| 0511 | RETURN | Skip if Y ≠ 0 |
| 0610 | $Log_{10}X$ | Skip if X positive |
| 0611 | $Log_eX$ | Skip if X = O |
| 0710 | SET EXP | Skip if X negative |
| 0711 | CHANGE SIGN | Skip if X ≠ 0 |

Miscellaneous

| | | |
|---|---|---|
| 0615 | 1/X | Pause |
| 0514 | GO | 180/π |
| 0515 | STOP | π/180 |

The specific program for providing a porosity drilling log which illustrates the invention has 650 steps and is as follows:

| STEP | CODE | KEY | COMMENTS |
|---|---|---|---|
| 0000 | 04 08 | MARK | (Calculator waiting for signal of compeltion of 2 ft.) |
| 0001 | 01 06 | 0106 | |
| 0002 | 04 09 | GROUP 1 | (Wait for interfacer signal to continue) |
| 0003 | 15 00 | | |
| 0004 | 04 07 | SEARCH | |
| 0005 | 00 01 | 0001 | |
| 0006 | 05 14 | GO | |
| 0007 | 04 08 | MARK | (Evaluating of Cos θ) |
| 0008 | 00 03 | 0003 | |
| 0009 | 06 04 | ↑ | |
| 0010 | 07 03 | 3 | |
| 0011 | 07 06 | 6 | |
| 0012 | 07 00 | 0 | |
| 0013 | 06 03 | ÷ | |
| 0014 | 06 05 | ↓ | |
| 0015 | 06 08 | INTEGER X | |
| 0016 | 06 01 | − | |
| 0017 | 07 04 | 4 | |
| 0018 | 06 02 | X | |
| 0019 | 06 05 | ↓ | |
| 0020 | 06 08 | INTEGER X | |
| 0021 | 06 01 | − | |
| 0022 | 04 12 | WRITE ALPHA | (Cosine test) |
| 0023 | 06 12 | $\sqrt{X}$ | " |
| 0024 | 06 09 | π | |
| 0025 | 06 02 | X | |
| 0026 | 07 02 | 2 | |
| 0027 | 06 03 | ÷ | |
| 0028 | 06 05 | ↓ | |
| 0029 | 07 13 | $X^2$ | |
| 0030 | 04 04 | STORE DIRECT | |
| 0031 | 00 03 | 0003 | |
| 0032 | 07 01 | 1 | |
| 0033 | 07 06 | 6 | |
| 0034 | 06 04 | ↑ | |
| 0035 | 07 01 | 1 | |
| 0036 | 04 04 | STORE DIRECT | |
| 0037 | 00 00 | 0000 | |

-continued

| STEP | CODE | KEY | COMMENTS |
|---|---|---|---|
| 0038 | 04 03 | MARK | |
| 0039 | 15 14 | 1514 | |
| 0040 | 04 05 | RECALL DIRECT | |
| 0041 | 00 03 | 0003 | |
| 0042 | 04 02 | X DIRECT | |
| 0043 | 00 00 | 0000 | |
| 0044 | 06 05 | ↓ | |
| 0045 | 04 03 | ÷ DIRECT | |
| 0046 | 00 00 | 0000 | |
| 0047 | 07 01 | 1 | |
| 0048 | 06 01 | − | |
| 0049 | 06 05 | ↓ | |
| 0050 | 07 11 | CHANGE SIGN | |
| 0051 | 04 03 | ÷ DIRECT | |
| 0052 | 00 00 | 0000 | |
| 0053 | 07 01 | 1 | |
| 0054 | 06 01 | − | |
| 0055 | 04 00 | + DIRECT | |
| 0056 | 00 00 | 0000 | |
| 0057 | 04 12 | WRITE ALPHA | SKIP if Z = 0 |
| 0058 | 04 11 | WRITE | |
| 0059 | 04 07 | SEARCH | |
| 0060 | 15 14 | 1514 | |
| 0061 | 04 15 | RECALL Y | |
| 0062 | 00 00 | 0000 | |
| 0063 | 07 12 | DECIMAL POINT | |
| 0064 | 07 05 | 5 | |
| 0065 | 07 10 | SET EXP | |
| 0066 | 07 11 | CHANGE SIGN | |
| 0067 | 07 01 | 1 | |
| 0068 | 07 01 | 1 | |
| 0069 | 06 01 | − | |
| 0070 | 06 01 | − | |
| 0071 | 06 05 | | |
| 0072 | 04 12 | WRITE ALPHA | SET SIGN |
| 0073 | 05 12 | END PROGRAM | |
| 0074 | 04 07 | SEARCH | |
| 0075 | 15 15 | 1515 | |
| 0076 | 04 08 | MARK | EVALUATION OF TAN $\theta$ |
| 0077 | 00 07 | 0007 | |
| 0078 | 04 12 | WRITE ALPHA | ARC TAN 90° TEST |
| 0079 | 07 15 | CLEAR X | |
| 0080 | 06 04 | ↑ | |
| 0081 | 07 12 | DECIMAL POINT | |
| 0082 | 07 05 | 5 | |
| 0083 | 05 07 | SKIP IF Y ≧ X | |
| 0084 | 04 12 | WRITE ALPHA | ARC TAN 45° TEST |
| 0085 | 07 13 | $X^2$ | |
| 0086 | 07 01 | 1 | |
| 0087 | 06 00 | + | |
| 0088 | 04 14 | STORE Y | |
| 0089 | 00 00 | 0000 | |
| 0090 | 07 02 | 2 | |
| 0091 | 06 01 | − | |
| 0092 | 04 05 | RECALL DIRECT | |
| 0093 | 00 00 | 0000 | |
| 0094 | 06 03 | ÷ | |
| 0095 | 06 05 | ↓ | |
| 0096 | 04 14 | STORE Y | |
| 0097 | 00 01 | 0001 | |
| 0098 | 06 02 | X | |
| 0099 | 04 14 | STORE Y | |
| 0100 | 00 00 | 0000 | |
| 0101 | 07 01 | 1 | |
| 0102 | 04 04 | STORE DIRECT | |
| 0103 | 00 03 | 0003 | |
| 0104 | 07 01 | 1 | |
| 0105 | 07 05 | 5 | |
| 0106 | 06 04 | ↑ | |
| 0107 | 07 08 | 8 | |
| 0108 | 04 04 | STORE DIRECT | |
| 0109 | 00 02 | 0002 | |
| 0110 | 04 08 | MARK | |
| 0111 | 15 13 | 1513 | |
| 0112 | 04 05 | RECALL DIRECT | |
| 0113 | 00 00 | 0000 | |
| 0114 | 04 02 | X DIRECT | |
| 0115 | 00 03 | 0003 | |
| 0116 | 04 05 | RECALL DIRECT | |
| 0117 | 00 02 | 0002 | |
| 0118 | 04 02 | X DIRECT | |
| 0119 | 00 02 | 0002 | |
| 0120 | 04 06 | DIRECT | |
| 0121 | 00 02 | 0002 | |
| 0122 | 04 02 | X DIRECT | |

-continued

| STEP | CODE | KEY | COMMENTS |
|---|---|---|---|
| 0123 | 00 03 | 0003 | |
| 0124 | 06 05 | ↓ | |
| 0125 | 04 00 | + DIRECT | |
| 0126 | 00 03 | 0003 | |
| 0127 | 07 02 | 2 | |
| 0128 | 06 01 | − | |
| 0129 | 07 01 | 1 | |
| 0130 | 04 01 | − DIRECT | |
| 0131 | 00 02 | 0002 | |
| 0132 | 04 06 | DIRECT | |
| 0133 | 00 03 | 0003 | |
| 0134 | 04 03 | ÷ DIRECT | |
| 0135 | 00 03 | 0003 | |
| 0136 | 04 05 | RECALL DIRECT | |
| 0137 | 00 02 | 0002 | |
| 0138 | 04 12 | WRITE ALPHA | SKIP if X = 0 |
| 0139 | 06 11 | $LOGE_eX$ | |
| 0140 | 04 07 | SEARCH | |
| 0141 | 15 13 | 1513 | |
| 0142 | 04 15 | RECALL Y | |
| 0143 | 00 01 | 0001 | |
| 0144 | 04 05 | RECALL DIRECT | |
| 0145 | 00 03 | 0003 | |
| 0146 | 06 02 | X | |
| 0147 | 04 12 | WRITE ALPHA | $180/\pi$ |
| 0148 | 05 14 | GO | |
| 0149 | 06 02 | X | |
| 0150 | 07 04 | 4 | |
| 0151 | 07 05 | 5 | |
| 0152 | 04 12 | WRITE ALPHA | AVERAGE TANGENT SET |
| 0153 | 06 13 | $10^X$ | |
| 0154 | 06 05 | ↓ | |
| 0155 | 04 12 | WRITE ALPHA | SET SIGN |
| 0156 | 05 12 | END PROGRAM | |
| 0157 | 04 07 | SEARCH | |
| 0158 | 05 06 | INDIRECT | |
| 0159 | 04 08 | MARK | TRANSFER OF COS $\theta$ INTO Y REGISTER |
| 0160 | 15 15 | 1515 | |
| 0161 | 12 15 | RECALL Y | |
| 0162 | 14 08 | 248 | |
| 0163 | 04 07 | SEARCH | |
| 0164 | 00 05 | 0005 | |
| 0165 | 04 08 | MARK | TRANSFER OF TAN $\theta$ INTO Y REGISTER |
| 0166 | 05 06 | INDIRECT | |
| 0167 | 12 15 | RECALL Y | |
| 0168 | 14 08 | 248 | |
| 0169 | 04 07 | SEARCH | |
| 0170 | 00 06 | 0006 | |
| 0171 | 04 08 | MARK | CHECK IF DEPTH IS CORRECT |
| 0172 | 00 01 | 0001 | |
| 0173 | 04 09 | GROUP 1 | |
| 0174 | 15 01 | 1501 | |
| 0175 | 06 04 | ↑ | |
| 0176 | 04 09 | GROUP 1 | |
| 0177 | 15 01 | 1501 | |
| 0178 | 05 09 | SKIP IF Y = X | |
| 0179 | 04 07 | SEARCH | |
| 0180 | 00 01 | 0001 | |
| 0181 | 04 07 | SEARCH | |
| 0182 | 02 05 | 0205 | |
| 0183 | 05 14 | GO | |
| 0184 | 05 14 | " | |
| 0185 | 05 14 | " | |
| 0186 | 05 14 | " | |
| 0187 | 05 14 | " | |
| 0188 | 04 08 | MARK | RETRIEVAL AND STORING OF DATA INTO WANG |
| 0189 | 02 05 | 0205 | |
| 0190 | 04 09 | GROUP 1 | |
| 0191 | 15 03 | 1503 | |
| 0192 | 04 14 | STORE Y | |
| 0193 | 00 05 | 0005 | |
| 0194 | 04 04 | STORE X | |
| 0195 | 02 07 | 0207 | |
| 0196 | 04 09 | GROUP 1 | |
| 0197 | 15 05 | 1505 | |
| 0198 | 06 04 | ↑ | |
| 0199 | 04 09 | GROUP 1 | |
| 0200 | 15 07 | 1507 | |
| 0201 | 04 14 | STORE Y | |
| 0202 | 02 08 | 0208 | |
| 0203 | 04 12 | WRITE ALPHA | |
| 0204 | 07 02 | 2 | |
| 0205 | 04 04 | STORE DIRECT | |
| 0206 | 01 06 | 0106 | |
| 0207 | 04 09 | GROUP 1 | |
| 0208 | 14 01 | 1401 | |
| 0209 | 04 12 | WRITE ALPHA | |
| 0210 | 07 04 | 4 | |
| 0211 | 04 04 | STORE DIRECT | |

-continued

| STEP | CODE | KEY | COMMENTS |
|---|---|---|---|
| 0212 | 01 07 | 0107 | |
| 0213 | 04 15 | RECALL Y | EVALUATE TURNS FOR THIS |
| 0214 | 02 08 | 0208 | 2 FT. |
| 0215 | 04 05 | RECALL DIRECT | |
| 0216 | 00 09 | 0009 | |
| 0217 | 06 01 | − | |
| 0213 | 04 14 | STORE Y | |
| 0219 | 01 08 | 0108 | |
| 0220 | 04 05 | RECALL DIRECT | AVG.NET TORQUE TN/N |
| 0221 | 01 07 | 0107 | |
| 0222 | 06 06 | | |
| 0223 | 06 03 | ÷ | |
| 0224 | 06 05 | ↓ | |
| 0225 | 04 04 | STORE DIRECT | |
| 0226 | 04 02 | X DIRECT | |
| 0227 | 07 00 | 0 | |
| 0228 | 04 04 | STORE DIRECT | |
| 0229 | 04 00 | + DIRECT | |
| 0230 | 05 14 | GO | |
| 0231 | 05 14 | GO | |
| 0232 | 04 15 | RECALL Y | IS BIT ROCK OR INSERT? |
| 0233 | 00 07 | 0007 | |
| 0234 | 07 09 | 9 | |
| 0235 | 05 08 | SKIP IF Y<X | |
| 0236 | 04 07 | SEARCH | |
| 0237 | 01 09 | 0109 | |
| 0238 | 04 05 | RECALL DIRECT | IS TOOTH GRADING LESS |
| 0239 | 02 08 | 0208 | THAN 0.50? |
| 0240 | 06 02 | X | |
| 0241 | 04 05 | RECALL DIRECT | |
| 0242 | 00 06 | 0006 | |
| 0243 | 06 03 | ÷ | |
| 0244 | 07 12 | DECIMAL POINT | |
| 0245 | 07 05 | 5 | |
| 0246 | 05 07 | SKIP IF Y≧X | |
| 0247 | 04 07 | SEARCH | |
| 0248 | 02 00 | 0200 | |
| 0249 | 05 14 | GO | IF LESS THAN 0.5 USE |
| 0250 | 06 05 | ↓ | 005 |
| 0251 | 04 07 | SEARCH | |
| 0252 | 02 00 | 0200 | |
| 0253 | 04 08 | MARK | |
| 0254 | 01 09 | 0109 | |
| 0255 | 07 01 | 1 | |
| 0256 | 04 08 | MARK | |
| 0257 | 02 00 | 0200 | |
| 0258 | 04 04 | STORE DIRECT | |
| 0259 | 03 07 | 0307 | |
| 0260 | 04 15 | RECALL Y | BEARING BRADING |
| 0261 | 01 06 | 0106 | EVALUATION. |
| 0262 | 07 08 | 8 | |
| 0263 | 06 02 | X | |
| 0264 | 04 05 | RECALL DIRECT | |
| 0265 | 01 02 | 0102 | |
| 0266 | 06 03 | ÷ | |
| 0267 | 04 14 | STORE Y | |
| 0268 | 03 09 | 0309 | |
| 0269 | 07 07 | 7 | IS BEARING GRADING |
| 0270 | 05 07 | SKIP IF Y≧X | GREATER THAN 7? |
| 0271 | 04 07 | SEARCH | |
| 0272 | 00 02 | 0002 | |
| 0273 | 06 01 | − | IF BEARING GRADING IS |
| 0274 | 07 02 | 2 | GREATER THAN 7 |
| 0275 | 07 00 | 0 | CORRECT TORQUE FOR |
| 0276 | 07 00 | 0 | DRAG |
| 0277 | 07 00 | 0 | |
| 0278 | 06 02 | X | |
| 0279 | 04 05 | RECALL DIRECT | |
| 0280 | 04 02 | X DIRECT | |
| 0281 | 06 06 | | |
| 0282 | 06 01 | − | |
| 0283 | 06 05 | ↓ | |
| 0284 | 04 04 | STORE DIRECT | |
| 0285 | 04 00 | + DIRECT | |
| 0286 | 04 15 | RECALL Y | |
| 0287 | 01 08 | 0108 | |
| 0288 | 06 02 | X | |
| 0289 | 04 14 | STORE Y | |
| 0290 | 04 01 | − DIRECT | |
| 0291 | 04 07 | SEARCH | |
| 0292 | 02 01 | 0201 | |
| 0293 | 04 08 | MARK | CORRECT TORQUE FOR $T_o$ |
| 0294 | 00 02 | 0002 | (no drilling on bottom |
| 0295 | 04 05 | RECALL DIRECT | torque) |
| 0296 | 04 02 | X DIRECT | |
| 0297 | 04 00 | + DIRECT | |
| 0298 | 04 00 | + DIRECT | |
| 0299 | 04 15 | RECALL Y | |
| 0300 | 04 00 | + DIRECT | |
| 0301 | 04 05 | RECALL DIRECT | |
| 0302 | 01 08 | 0108 | |
| 0303 | 06 02 | X | |
| 0304 | 04 14 | STORE Y | |

-continued

| STEP | CODE | KEY | COMMENTS |
|---|---|---|---|
| 0305 | 04 01 | – DIRECT | |
| 0306 | 05 14 | GO | |
| 0307 | 05 14 | GO | |
| 0308 | 04 08 | MARK | NET KILOPOUNDS TURNS FOR 2 FT. |
| 0309 | 02 01 | 0201 | |
| 0310 | 04 15 | RECALL Y | |
| 0311 | 01 06 | 0106 | |
| 0312 | 04 05 | RECALL DIRECT | |
| 0313 | 01 00 | 0100 | |
| 0314 | 06 01 | – | |
| 0315 | 04 14 | STORE Y | |
| 0316 | 03 06 | 0306 | |
| 0317 | 04 15 | RECALL Y | |
| 0318 | 02 07 | 0207 | |
| 0319 | 04 05 | RECALL DIRECT | NET TIME FOR 2 FT. |
| 0320 | 00 08 | 0008 | |
| 0321 | 06 01 | – | |
| 0322 | 06 05 | ↓ | |
| 0323 | 04 06 | DIRECT | |
| 0324 | 05 06 | INDIRECT | |
| 0325 | 04 04 | STORE DIRECT | |
| 0326 | 05 08 | SKIP IF Y<X | |
| 0327 | 04 14 | STORE Y | |
| 0328 | 03 08 | 0308 | |
| 0329 | 05 14 | GO | |
| 0330 | 05 14 | GO | |
| 0331 | 04 08 | MARK | CALCULATE T/WD |
| 0332 | 02 02 | 0202 | |
| 0333 | 04 15 | STORE Y | |
| 0334 | 01 04 | 0104 | |
| 0335 | 07 01 | 1 | |
| 0336 | 07 02 | 2 | |
| 0337 | 06 03 | ÷ | |
| 0338 | 04 05 | RECALL DIRECT | |
| 0339 | 01 07 | 0107 | |
| 0340 | 06 03 | ÷ | |
| 0341 | 04 05 | RECALL DIRECT | |
| 0342 | 03 06 | 0306 | |
| 0343 | 06 02 | X | |
| 0344 | 06 06 | ↓ | |
| 0345 | 06 15 | 1/X | |
| 0346 | 04 04 | STORE DIRECT | |
| 0347 | 02 00 | 0200 | |
| 0348 | 05 14 | GO | |
| 0349 | 05 14 | GO | |
| 0350 | 04 08 | MARK | |
| 0351 | 00 04 | 0004 | EVALUATION OF $\theta$ |
| 0352 | 07 04 | 4 | |
| 0353 | 06 03 | ÷ | |
| 0354 | 06 05 | ↓ | |
| 0355 | 04 07 | SEARCH | CALULATION OF DENOMINATOR OF POROSITY EQUATION |
| 0356 | 00 07 | 0007 | |
| 0357 | 04 08 | MARK | |
| 0358 | 00 06 | 0006 | |
| 0359 | 07 02 | 2 | |
| 0360 | 06 02 | X | |
| 0361 | 06 05 | ↓ | |
| 0362 | 05 14 | GO | |
| 0363 | 05 14 | GO | |
| 0364 | 04 07 | SEARCH | |
| 0365 | 00 03 | 0003 | |
| 0366 | 05 14 | GO | |
| 0367 | 05 14 | GO | |
| 0368 | 04 08 | MARK | |
| 0369 | 00 05 | 0005 | |
| 0370 | 04 14 | STORE Y | |
| 0371 | 02 01 | 0201 | |
| 0372 | 07 01 | 1 | |
| 0373 | 04 01 | – DIRECT | |
| 0374 | 02 01 | 0201 | |
| 0375 | 06 00 | + | |
| 0376 | 04 05 | RECALL DIRECT | |
| 0377 | 02 01 | 0201 | |
| 0378 | 06 03 | ÷ | |
| 0379 | 04 14 | STORE Y | |
| 0380 | 02 01 | 0201 | |
| 0381 | 05 14 | GO | |
| 0382 | 05 14 | GO | |
| 0383 | 04 08 | MARK | |
| 0384 | 00 08 | 0008 | |
| 0385 | 04 15 | RECALL Y | |
| 0386 | 01 03 | 0103 | |
| 0387 | 04 05 | RECALL DIRECT | |
| 0388 | 02 03 | 0203 | |
| 0389 | 06 02 | X | |
| 0390 | 04 05 | RECALL DIRECT | |
| 0391 | 02 02 | 0202 | |
| 0392 | 06 01 | – | |
| 0393 | 04 05 | RECALL DIRECT | |
| 0394 | 00 05 | 0005 | |
| 0395 | 06 02 | X | |
| 0396 | 04 05 | RECALL DIRECT | |
| 0397 | 02 01 | 0201 | |

-continued

| STEP | CODE | KEY | COMMENTS |
|---|---|---|---|
| 0398 | 06 02 | X | |
| 0399 | 04 14 | STORE Y | |
| 0400 | 04 03 | ÷ DIRECT | |
| 0401 | 05 14 | GO | |
| 0402 | 05 14 | GO | |
| 0403 | 04 08 | MARK | |
| 0404 | 00 09 | 0009 | |
| 0405 | 04 15 | RECALL Y | |
| 0406 | 03 06 | 0306 | |
| 0407 | 04 05 | RECALL DIRECT | EVALUATION OF POROSITY |
| 0408 | 02 04 | 0204 | |
| 0409 | 06 03 | ÷ | |
| 0410 | 04 05 | RECALL DIRECT | |
| 0411 | 01 04 | 0104 | |
| 0412 | 06 03 | ÷ | |
| 0413 | 04 05 | RECALL DIRECT | |
| 0414 | 02 00 | 0200 | |
| 0415 | 06 02 | X | |
| 0416 | 07 09 | 9 | |
| 0417 | 07 06 | 6 | |
| 0418 | 06 02 | X | |
| 0419 | 04 05 | RECALL DIRECT | |
| 0420 | 04 03 | ÷ DIRECT | |
| 0421 | 06 01 | − | |
| 0422 | 04 14 | STORE Y | |
| 0423 | 03 04 | 0304 | |
| 0424 | 04 05 | RECALL DIRECT | |
| 0425 | 02 05 | 0205 | |
| 0426 | 06 06 | | EVALUATION OF SDL |
| 0427 | 06 03 | ÷ | (both ln and log) |
| 0428 | 07 01 | 1 | |
| 0429 | 07 04 | 4 | |
| 0430 | 07 04 | 4 | |
| 0431 | 06 02 | X | |
| 0432 | 06 05 | ↓ | |
| 0433 | 06 11 | $LOG_e X$ | |
| 0434 | 06 04 | ↑ | |
| 0435 | 04 05 | RECALL DIRECT | |
| 0436 | 02 06 | 0206 | |
| 0437 | 06 03 | ÷ | |
| 0438 | 04 14 | STORE Y | |
| 0439 | 03 01 | 0301 | |
| 0440 | 05 14 | GO | |
| 0441 | 05 14 | GO | |
| 0442 | 04 08 | MARK | |
| 0443 | 01 01 | 0101 | |
| 0444 | 04 15 | RECALL Y | |
| 0445 | 03 06 | 0306 | |
| 0446 | 04 05 | RECALL DIRECT | |
| 0447 | 03 07 | 0307 | |
| 0448 | 06 12 | $\sqrt{X}$ | |
| 0449 | 06 03 | ÷ | |
| 0450 | 04 05 | RECALL DIRECT | |
| 0451 | 00 05 | 0005 | |
| 0452 | 06 12 | $\sqrt[X]{\ }$ | |
| 0453 | 06 03 | ÷ | |
| 0454 | 04 05 | RECALL DIRECT | |
| 0455 | 02 09 | 0209 | |
| 0456 | 06 03 | ÷ | |
| 0457 | 04 14 | STORE Y | |
| 0458 | 03 02 | 0302 | |
| 0459 | 06 05 | ↓ | |
| 0460 | 06 11 | $LOG_e X$ | |
| 0461 | 04 15 | RECALL Y | |
| 0462 | 03 00 | 0300 | |
| 0463 | 06 00 | + | |
| 0464 | 06 05 | ↓ | |
| 0465 | 04 06 | DIRECT | |
| 0466 | 03 02 | 0302 | |
| 0467 | 06 10 | $LOG_{10} X$ | |
| 0468 | 04 04 | STORE DIRECT | |
| 0469 | 03 03 | 0303 | |
| 0470 | 04 05 | RECALL DIRECT | |
| 0471 | 03 05 | 0305 | |
| 0472 | 04 02 | X DIRECT | |
| 0473 | 03 03 | 0303 | |
| 0474 | 04 12 | WRITE ALPHA | TYPEWRITER ON AND |
| 0475 | 12 00 | TYPEWRITER ON | CARRIAGE RETURN |
| 0476 | 01 08 | RETURN CARRIAGE | |
| 0477 | 04 13 | END ALPHA | |
| 0478 | 07 01 | 1 | UPDATE AND TYPE LINE |
| 0479 | 04 00 | + DIRECT | NUMBER |
| 0480 | 01 01 | 0101 | |
| 0481 | 04 05 | RECALL DIRECT | |
| 0482 | 01 01 | 0101 | |
| 0483 | 04 11 | WRITE | |
| 0484 | 03 00 | 3 DIGITS | |
| 0485 | 04 11 | WRITE | SPACE 3 TIMES |
| 0486 | 15 03 | 1503 | |
| 0487 | 04 05 | RECALL DIRECT | TYPE DEPTH |

-continued

| STEP | CODE | KEY | COMMENTS |
|---|---|---|---|
| 0488 | 00 05 | 0005 | |
| 0489 | 04 11 | WRITE | |
| 0490 | 09 00 | 9 DIGITS | |
| 0491 | 04 15 | RECALL Y | NEXT DEPTH EVALUATION |
| 0492 | 02 04 | 0204 | |
| 0493 | 06 00 | + | |
| 0494 | 06 05 | ↓ | |
| 0495 | 04 12 | WRITE ALPHA | DIVIDE X BY 10′ |
| 0496 | 04 01 | – DIRECT | |
| 0497 | 06 08 | INTEGER X | |
| 0498 | 04 12 | WRITE ALPHA | MULTIPLY X BY 10′ |
| 0499 | 07 01 | 1 | |
| 0500 | 06 01 | – | |
| 0501 | 04 14 | STORE Y | |
| 0502 | 00 04 | 0004 | |
| 0503 | 05 14 | GO | |
| 0504 | 05 14 | GO | |
| 0505 | 04 08 | MARK | |
| 0506 | 01 04 | 0104 | |
| 0507 | 04 15 | RECALL Y | ROUND OFF AND TYPE POROSITY |
| 0508 | 03 01 | 0301 | |
| 0509 | 07 12 | DECIMAL POINT | |
| 0510 | 07 00 | 0 | |
| 0511 | 07 00 | 0 | |
| 0512 | 07 00 | 5 | |
| 0513 | 06 00 | + | |
| 0514 | 06 05 | ↓ | |
| 0515 | 04 12 | WRITE ALPHA | |
| 0516 | 07 02 | 2 | |
| 0517 | 06 08 | INTEGER X | |
| 0518 | 04 12 | WRITE ALPHA | |
| 0519 | 04 02 | X DIRECT | |
| 0520 | 04 11 | WRITE | |
| 0521 | 04 02 | 4 DIGIT,2 DECIMALS | |
| 0522 | 05 14 | GO | |
| 0523 | 05 14 | GO | |
| 0524 | 04 15 | RECALL Y | ROUND OFF AND TYPE SDL (log) |
| 0525 | 03 03 | 0303 | |
| 0526 | 07 12 | DECIMAL POINT | |
| 0527 | 07 00 | 0 | |
| 0528 | 07 00 | 0 | |
| 0529 | 07 05 | 5 | |
| 0530 | 06 00 | + | |
| 0531 | 06 05 | ↓ | |
| 0532 | 04 12 | WRITE ALPHA | MULTIPLY X BY $10^2$ |
| 0533 | 07 02 | 2 | |
| 0534 | 06 08 | INTEGER X | |
| 0535 | 04 12 | WRITE ALPHA | DIVIDE X BY $10^2$ |
| 0536 | 04 02 | X DIRECT | |
| 0537 | 04 11 | WRITE | |
| 0538 | 04 01 | X DIRECT | |
| 0539 | 05 14 | GO | |
| 0540 | 04 14 | GO | |
| 0541 | 04 15 | RECALL Y | ROUND OFF AND TYPE SDL (ln) |
| 0542 | 03 02 | 0302 | |
| 0543 | 07 12 | DECIMAL POINT | |
| 0544 | 07 00 | 0 | |
| 0545 | 07 00 | 0 | |
| 0546 | 07 05 | 5 | |
| 0547 | 06 00 | + | |
| 0548 | 06 05 | ↓ | |
| 0549 | 04 12 | WRITE ALPHA | MULTIPLY X BY $10^2$ |
| 0550 | 07 02 | 2 | |
| 0551 | 06 08 | INTEGER X | |
| 0552 | 04 12 | WRITE ALPHA | DIVIDE Y BY $10^2$ |
| 0553 | 04 02 | X DIRECT | |
| 0554 | 04 11 | WRITE | |
| 0555 | 04 02 | X DIRECT | |
| 0556 | 05 14 | GO | |
| 0557 | 05 14 | GO | |
| 0558 | 04 11 | WRITE | SPACE 5 TIMES |
| 0559 | 15 05 | 1505 | |
| 0560 | 04 05 | RECALL DIRECT | TYPE N (TURNS) AND UPDATE REGISTER |
| 0561 | 02 08 | 0208 | |
| 0562 | 04 11 | WRITE | |
| 0563 | 09 00 | 9 DIGITS | |
| 0564 | 04 06 | DIRECT | |
| 0565 | 00 09 | 0009 | |
| 0566 | 05 14 | GO | |
| 0567 | 05 14 | GO | |
| 0568 | 04 05 | RECALL DIRECT | TYPE WN AND UPDATE |

-continued

| STEP | CODE | KEY | COMMENTS |
|---|---|---|---|
| 0569 | 01 06 | 0106 | REGISTER |
| 0570 | 04 11 | WRITE | |
| 0571 | 09 00 | 9 DIGITS | |
| 0572 | 04 06 | DIRECT | |
| 0573 | 01 00 | 0100 | |
| 0574 | 05 14 | GO | |
| 0575 | 05 14 | GO | |
| 0576 | 04 058 | RECALL DIRECT | TYPE TIME AND UPDATE |
| 0577 | 02 07 | 0207 | REGISTER |
| 0578 | 04 11 | WRITE | |
| 0579 | 09 00 | 9 DIGITS | |
| 0580 | 04 06 | DIRECT | |
| 0581 | 00 08 | 0008 | |
| 0582 | 04 15 | RECALL Y | ROUNDOFF AND TYPE |
| 0583 | 04 01 | – DIRECT | TN(TORQUE X TURNS) |
| 0584 | 07 12 | DECIMAL POINT | |
| 0585 | 07 00 | 0 | |
| 0586 | 07 05 | 5 | |
| 0587 | 06 00 | + | |
| 0588 | 06 05 | ↓ | |
| 0589 | 04 12 | WRITE ALPHA | MULTIPLY X BY $10^1$ |
| 0590 | 07 01 | 1 | |
| 0591 | 0608 | INTEGER X | |
| 0592 | 04 12 | WRITE ALPHA | DIVIDE X BY $10^1$ |
| 0593 | 04 01 | – DIRECT | |
| 0594 | 04 11 | WRITE | |
| 0595 | 08 01 | 8 DIGITS, 1 DECIMAL | |
| 0596 | 04 11 | WRITE | SPACE 5 TIMES |
| 0597 | 15 05 | 1505 | |
| 0598 | 04 05 | RECALL DIRECT | ROUNDOFF AND TYPE |
| 0599 | 02 00 | 0200 | T/WD |
| 0600 | 04 12 | WRITE ALPHA | MULTIPLY X BY $10^2$ |
| 0601 | 07 02 | 2 | |
| 0602 | 05 14 | GO | |
| 0603 | 06 08 | INTEGER X | |
| 0604 | 04 12 | WRITE ALPHA | DIVIDE X BY $10^2$ |
| 0605 | 04 02 | X DIRECT | |
| 0606 | 04 11 | WRITE | |
| 0607 | 05 02 | 5 DIGITS,2 DECIMALS | |
| 0608 | 04 05 | RECALL DIRECT | TYPE MUD WEIGHT |
| 0609 | 01 03 | 0103 | |
| 0610 | 04 11 | WRITE | |
| 0611 | 05 02 | 5 DIGITS,2 DECIMALS | |
| 0612 | 04 05 | RECALL DIRECT | TYPE BIT SIZE |
| 0613 | 01 04 | 0104 | |
| 0614 | 04 11 | WRITE | |
| 0615 | 02 03 | 2 DIGITS, 2 DECIMALS | |
| 0616 | 04 05 | RECALL DIRECT | |
| 0617 | 03 07 | 0307 | TYPE TOOTH GRADING |
| 0618 | 04 11 | WRITE | |
| 0619 | 03 03 | 3 DIGITS, 3 DECIMALS | |
| 0620 | 04 05 | RECALL DIRECT | TYPE BEARING GRADING |
| 0621 | 03 09 | 0309 | |
| 0622 | 04 11 | WRITE | |
| 0623 | 03 03 | 3 DIGITS, 3 DECIMALS | |
| 0624 | 04 05 | RECALL DIRECT | TYPE TORQUE (NET) |
| 0625 | 04 02 | X DIRECT | |
| 0626 | 04 11 | WRITE | |
| 0627 | 04 02 | 4 DIGITS, 2 DECIMALS | |
| 0628 | 04 15 | RECALL Y | SPACE IF 10TH FT. |
| 0629 | 00 05 | 0005 | |
| 0630 | 06 05 | ↓ | |
| 0631 | 04 12 | WRITE ALPHA | DIVIDE X BY $10^1$ |
| 0632 | 04 01 | – DIRECT | |
| 0633 | 06 08 | INTEGER X | |
| 0634 | 04 12 | WRITE ALPHA | MULTIPLY X BY $10^1$ |
| 0635 | 07 01 | 1 | |
| 0636 | 05 09 | SKIP IF Y = X | |
| 0637 | 04 07 | SEARCH | |
| 0638 | 01 05 | 0105 | |
| 0639 | 04 12 | WRITE ALPHA | |
| 0640 | 01 10 | LINE INDEX | |
| 0641 | 04 13 | END ALPHA | |
| 0642 | 05 14 | GO | |
| 0643 | 05 14 | GO | |
| 0644 | 04 08 | MARK | |
| 0645 | 01 05 | 0105 | |
| 0646 | 04 12 | WRITE ALPHA | TYPEWRITER OFF |
| 0647 | 12 01 | TYPEWRITER OFF | |
| 0648 | 04 13 | END ALPHA | |
| 0649 | 04 07 | SEARCH | |

-continued

| STEP | CODE | KEY | COMMENTS |
|---|---|---|---|
| 0650 | 01 06 | 0106 | |
| 0651 | 05 12 | END PROGRAM | |

The foregoing has been illustrated and described in considerable detail in accordance with the applicable statues. However, this is not to be taken as in any way limiting the invention, but merely as being illustrative thereof.

We claim:

1. Method for determining porosity of a formation from drilling response, wherein a bit is attached to the lower end of a drill string that is rotated while the downward force on said bit is controlled, comprising the steps of measuring the revolutions of said bit,
measuring the depth of said bit in the borehole,
measuring the weight on said bit,
determining the tooth dullness of said bit,
measuring the torque applied to said drill string,
determining a reference torque empirically, and
determining said porosity of combining said measurements and determinations.

2. Method according to claim 1, wherein said step of determining a reference torque comprises determining viscous drill string torque.

3. Method according to claim 2, wherein said step of determining a reference torque also comprises making a series of short duration weight vs. torque measurements.

4. Method according to claim 3, wherein said step of determining said porosity is carried out in accordance with the equation $$\phi = 1/\mu \ln \left\{ \frac{\sigma ca \max}{480\ NT/D^2R - P_e \left( \frac{1+\cos[2 \text{ arc cot}(4T/WD)]}{1-\cos[2 \text{ arc cot}(4T/WD)]} \right)} \right\}$$

where:

$\mu$ = ratio of total porosity to the porosity effecting the atmospheric compressive strength
$ln$ = natural logarithm of
$N$ = rotational speed of bit
$T$ = torque
$P_e$ = effective confining pressure
$D$ = bit diameter
$R$ = penetration rate
$W$ = weight on bit
$\sigma ca$ max = atmospheric compressive strength extrapolated back to zero porosity.

5. A system for determining porosity of a formation from drilling response, wherein a bit is attached to the lower end of a drill string that is rotated while the downward force on said bit is controlled, comprising in combination means for measuring the revolutions of said bit,
means for measuring the depth of said bit in the borehole,
means for determining the tooth dullness of said bit,
means for measuring the torque applied to said drill string, and
means for correlating said measurements and determination in conjunction with an empirical reference torque to provide a porosity log.

6. A system according to claim 5, wherein said means for correlating comprises an electronic calculator.

7. A system according to claim 6, wherein said means for measuring the revolutions comprises a tachometer.

8. A system for determining porosity of a formation from drilling response, wherein a bit is attached to the lower end of a drill string that is rotated while the downward force on said bit is controlled and wherein the torque applied to rotate said drill string is measured, comprising in combination means for measuring the revolutions of said bit comprising a tachometer,
means for measuring the depth of said bit in the borehole,
means for determining the tooth dullness of said bit,
means for correlating said measurements and determination in accordance with the equation $$\phi = 1/\mu \ln \left\{ \frac{\sigma ca \max}{480\ NT/D^2R - P_e \left( \frac{1+\cos[2 \text{ arc cot}(4T/WD)]}{1-\cos[2 \text{ arc cot}(4T/WD)]} \right)} \right\}$$

wherein:

$\mu$ = ratio of total porosity to the porosity effecting the atmospheric compressive strength
$ln$ = natural logarithm of
$N$ = rotational speed of bit
$T$ = torque
$P_e$ = effective confining pressure
$D$ = bit diameter
$R$ = penetration rate
$W$ = weight on bit
$\sigma ca$ max = atmospheric compressive strength extrapolated back to zero porosity, to represent a porosity parameter of the formation,
means for recording said porosity parameter on a record medium as it is advanced, and
means for advancing said record medium in accordance with the depth of said bit.

* * * * *